United States Patent [19]

Martinez

[11] 4,305,616

[45] Dec. 15, 1981

[54] MODULAR ELEMENTS HAVING SHAPES AND CONTOURS WHEREBY WHEN ASSEMBLED PRODUCE ARMCHAIRS, SOFAS AND THE LIKE

[75] Inventor: Georges Martinez, Bourg-Argental, France

[73] Assignee: Société G.M. S.A., France

[21] Appl. No.: 32,825

[22] Filed: Apr. 24, 1979

[30] Foreign Application Priority Data

Oct. 25, 1978 [FR] France ..... 78 30999

[51] Int. Cl.[3] ..... A47C 7/00

[52] U.S. Cl. ..... 297/440; 297/445; 297/422

[58] Field of Search ..... 297/440, 422, 445, 416; 108/153, 156, 155, 157

[56] References Cited

U.S. PATENT DOCUMENTS

| | | | |
|---|---|---|---|
| 2,536,326 | 1/1951 | Thaden | 297/440 |
| 2,605,820 | 8/1952 | Powellek | 297/416 |
| 2,641,311 | 6/1953 | Ingram, Jr. et al. | 297/445 X |
| 2,732,889 | 1/1956 | Healey | 297/416 |
| 2,793,685 | 5/1957 | Spitz | 297/440 |
| 2,864,438 | 12/1958 | Levine | 297/445 X |
| 3,658,382 | 4/1972 | Anderson | 297/445 |
| 3,759,571 | 9/1973 | Korch | 297/422 |
| 4,026,567 | 5/1977 | Rye | 297/422 |
| 4,074,919 | 2/1978 | Watts | 297/440 |
| 4,201,417 | 5/1980 | Griffith | 297/440 |

FOREIGN PATENT DOCUMENTS

| | | | |
|---|---|---|---|
| 1317939 | 1/1963 | France | 297/440 |
| 608472 | 9/1948 | United Kingdom | 297/416 |

*Primary Examiner*—Francis K. Zugel
*Attorney, Agent, or Firm*—Eric P. Schellin

[57] ABSTRACT

A modular construction for chairs, couches and the like having a base supporting frame provided with sides formed with horizontally arranged spaces or slots. Garnishing or veneering, elbow rest and seat back elements are provided with battens or tongues which are received in the spaces or slots of the base frame and are secured thereto by fastening elements, such as screws or the like. A foundation or support is provided on the base frame to receive and support a seat cushion.

7 Claims, 22 Drawing Figures

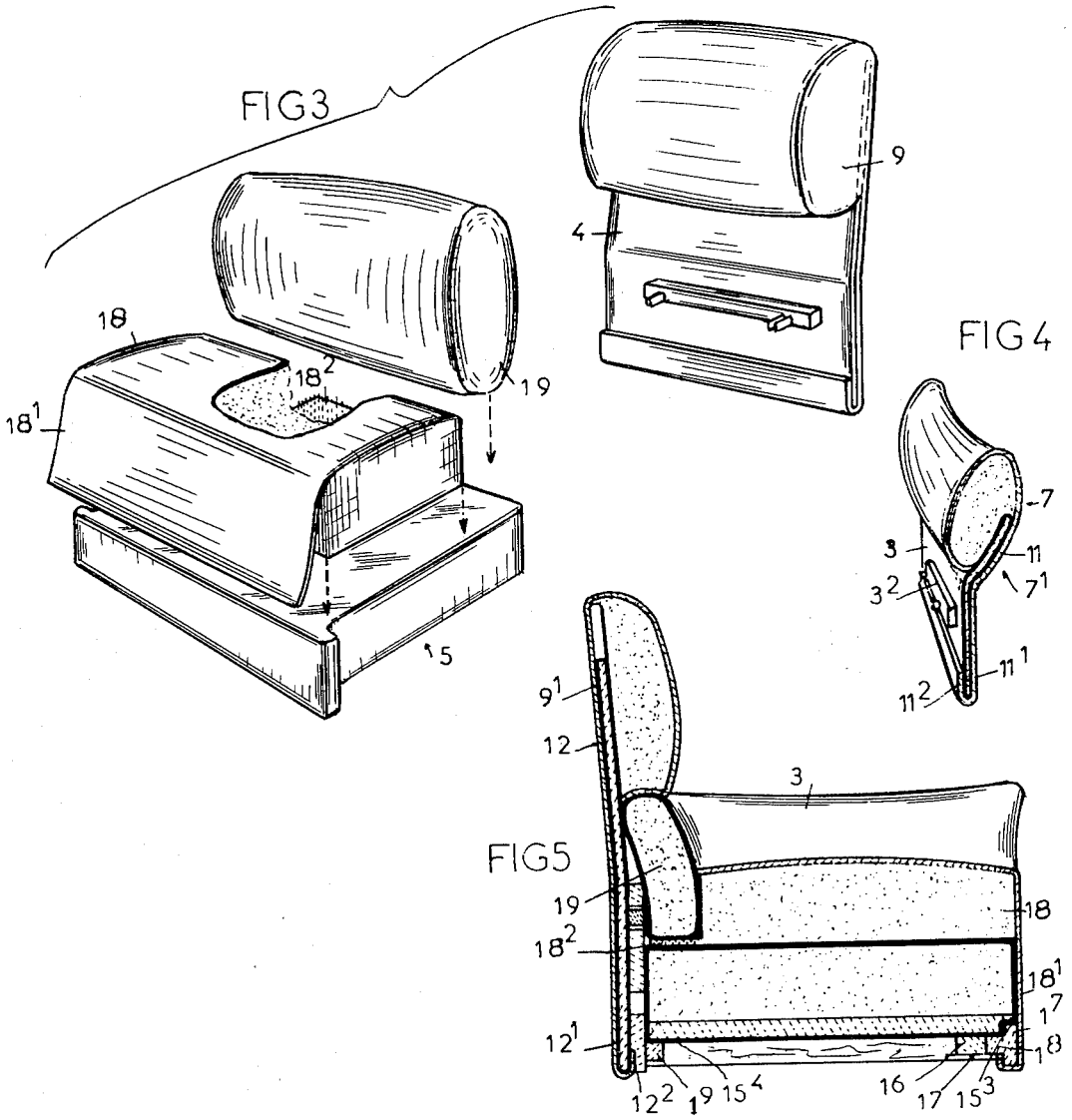
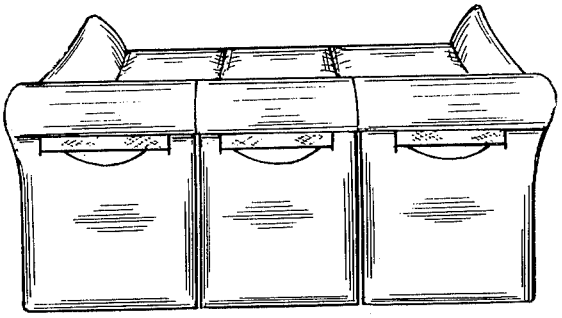
FIG9

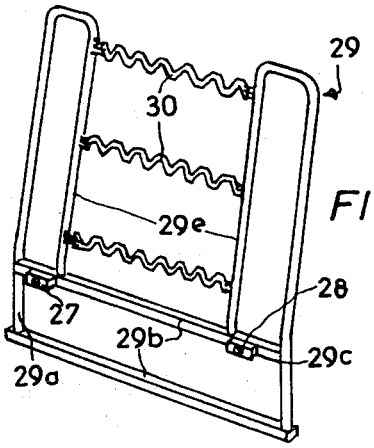
FIG.11
FIG.12
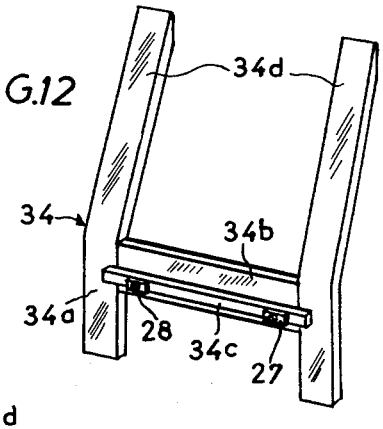
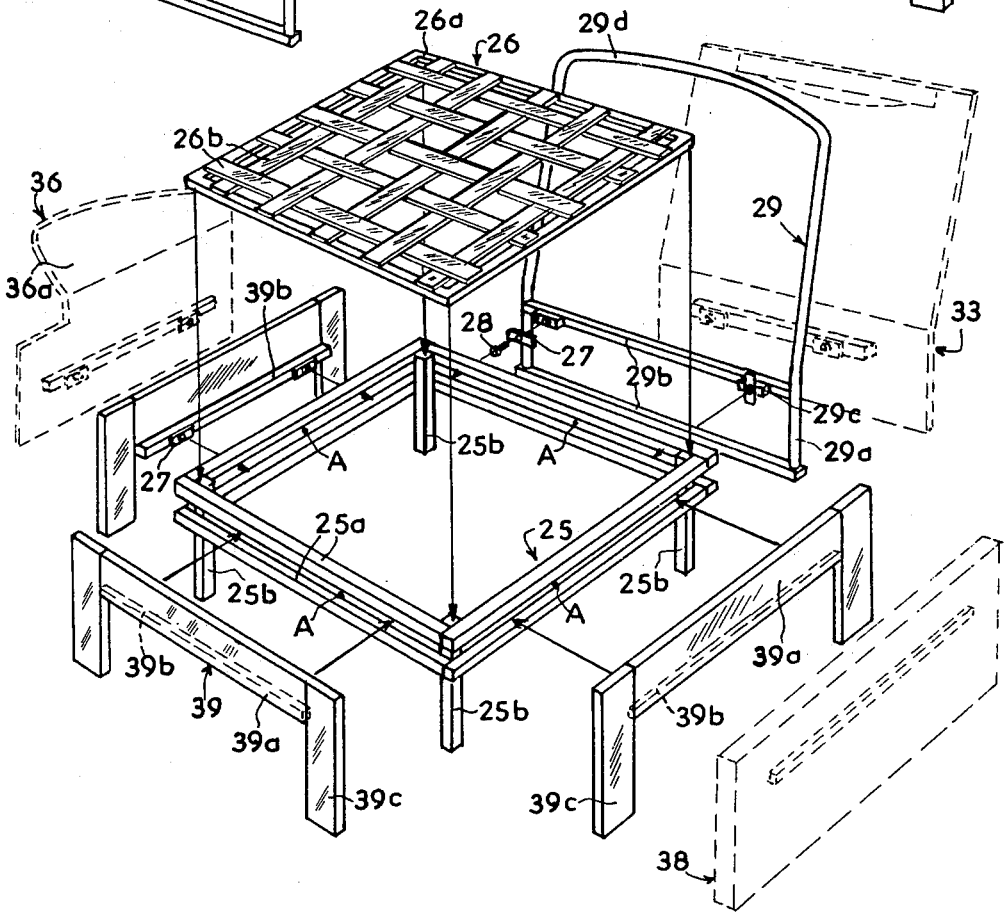
FIG.10

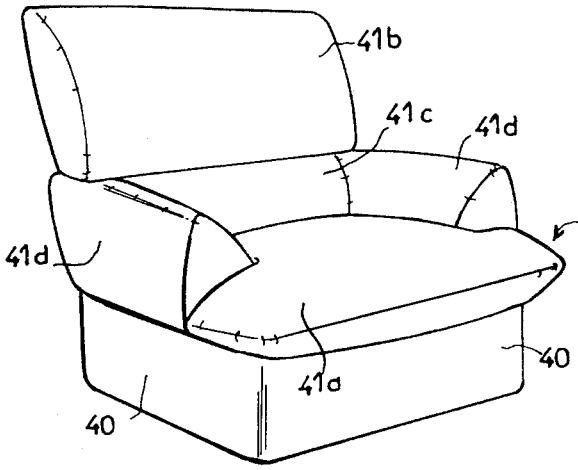
FIG.13
FIG.14
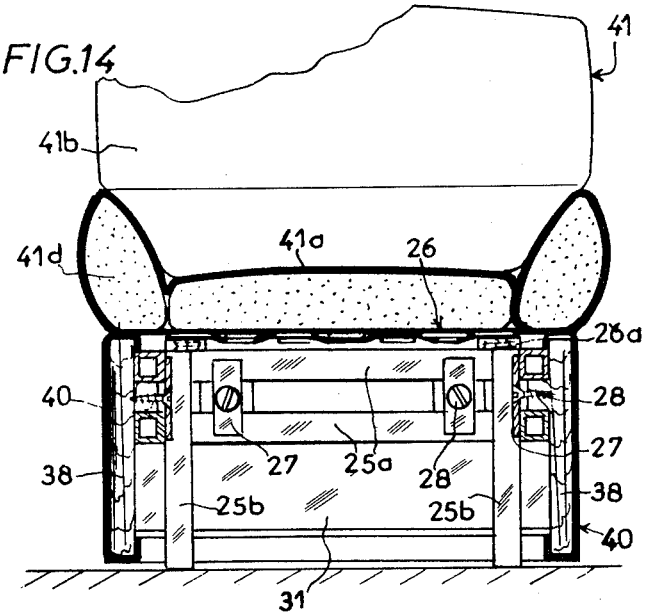
FIG.16
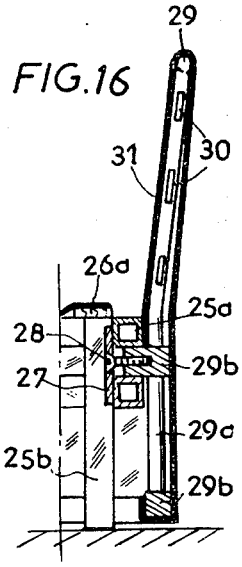
FIG.15
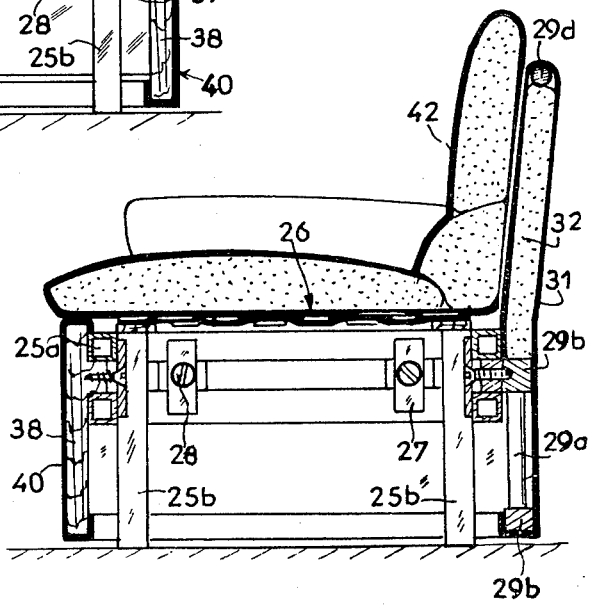

FIG.17
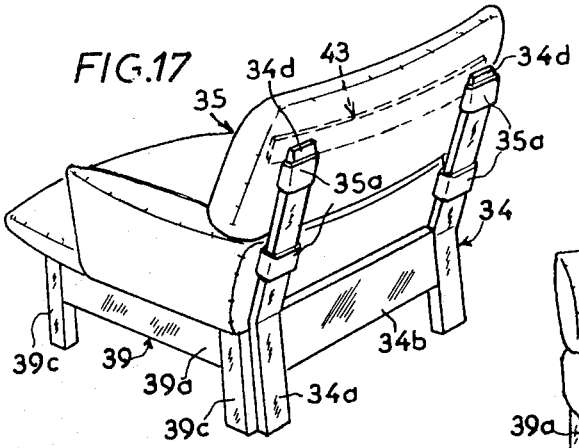
FIG.18
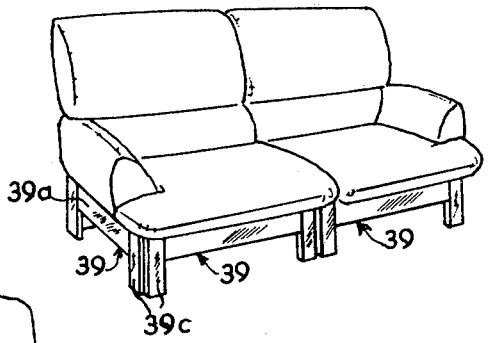
FIG.19
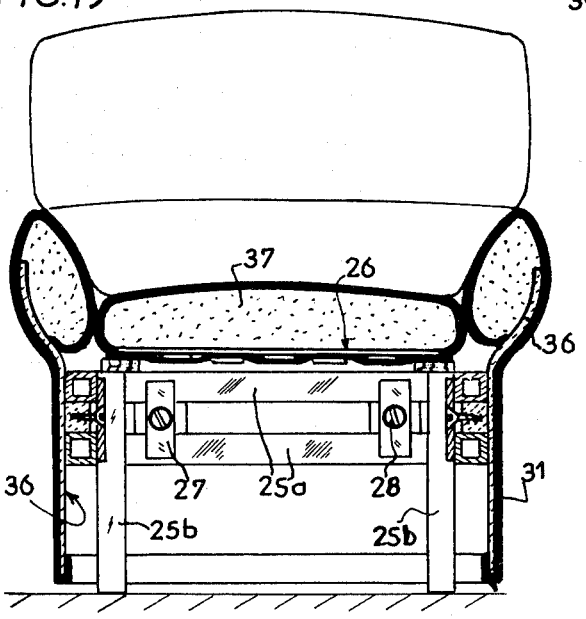
FIG.21
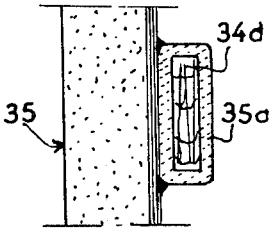
FIG.20
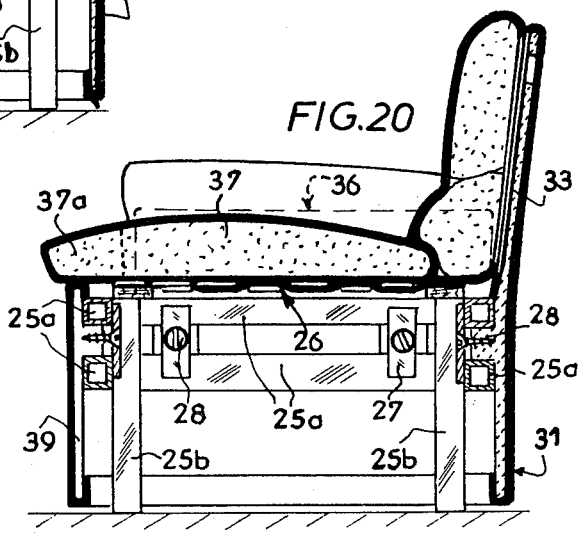
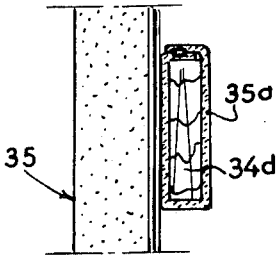
FIG.22

MODULAR ELEMENTS HAVING SHAPES AND CONTOURS WHEREBY WHEN ASSEMBLED PRODUCE ARMCHAIRS, SOFAS AND THE LIKE

The present invention concerns the shaped and curved modular elements and the procedures of their assembling aiming to create chairs, couches and similar.

The invention belongs to the technical domain of the furniture manufacturing.

According to a first characteristic of the invention, the shaped and curved elements are characterized by the fact that they constitute the framework of the back of seat and of the elbow-rests, this framework being made of the glass fibre reinforced polyester and include a lower part provided with a horizontal rib formed directly on the lower face, and an upper, shaped and curved part, each element being covered by a fabric cover, and permitting thanks to its curvature, placement and positioning of cushions forming the elbow rests or the back of seat, covered by a cover, which is in its turn attached to the said covered elements; by their flat part the said elements come to rest on the flat faces of a monobloc frame made namely of wood, in such a manner that their ribs penetrate in the corresponding slots provided on the lateral and back sides of the frame, and ensure the fastening of the elements to the frame with aid of any appropriate means; the front face of the frame remains open so as to permit the introduction and positioning of a foundation sole intended to receive on its upper face a cushion forming the seat, while an intermediary back-cushion is being placed beneath the cushion forming the back of the seat, the elbow rests and the seat forming cushion.

According to another characteristic, and as a variant, the base frame consists of risers attached rigidly on all frame sides by means of tubular or shaped braces made of metal or of any other material featuring convenient characteristics; between the braces and on every side there are located slots for the fitting and assembling of ribs or battens of the framework elements (back of seat, elbow rests), or of the corresponding garnishing or veneering elements; a foundation or a sole plane, namely for the seat cushion is formed, or placed and positioned on the base frame.

These characteristics as well as still others will reappear later in further description.

Figure 1:
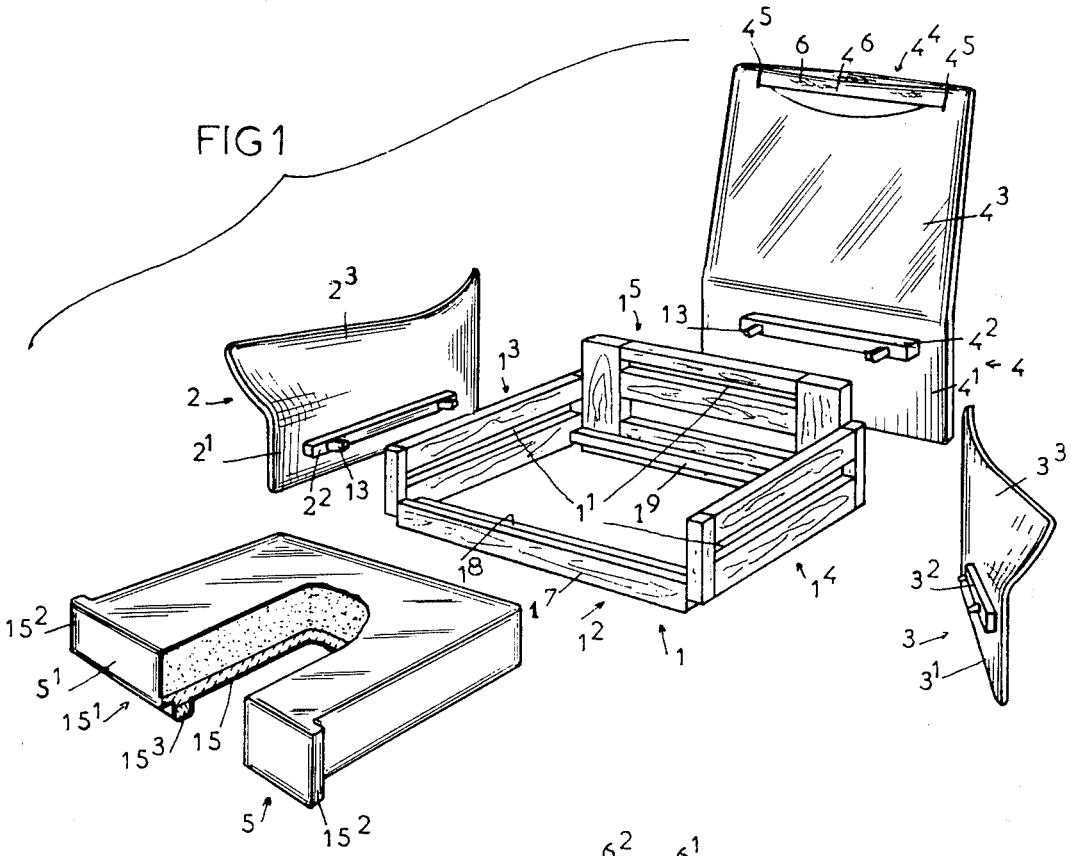

In order to define well the invention object, without limiting it, the adjoined drawings show:

The FIG. 1 is a perspective view of different elements constituting the chair according to the invention, the cushions being not shown.

Figure 2:
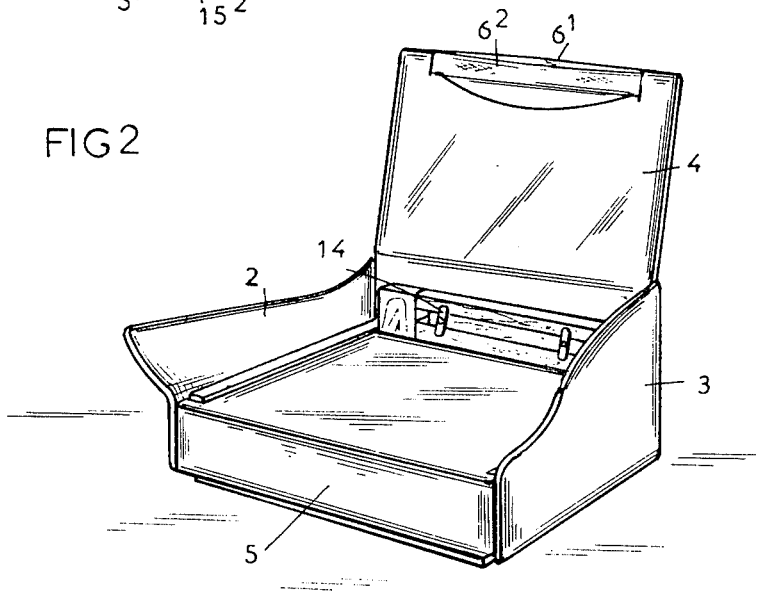

The FIG. 2 is a perspective view showing the positioning of different elements with respect to the frame.

The FIG. 3 is a perspective view showing the positioning of the foundation cushion and of the back intermediary cushion with respect to the foundation sole, as well as the back of seat forming element.

The FIG. 4 is a perspective view of a partial section of an element forming the elbow-rest, the cushion being provided with a cover intended to be used as the external cover of the element.

The FIG. 5 is a side view featuring a cross section of the chair.

Figure 6:
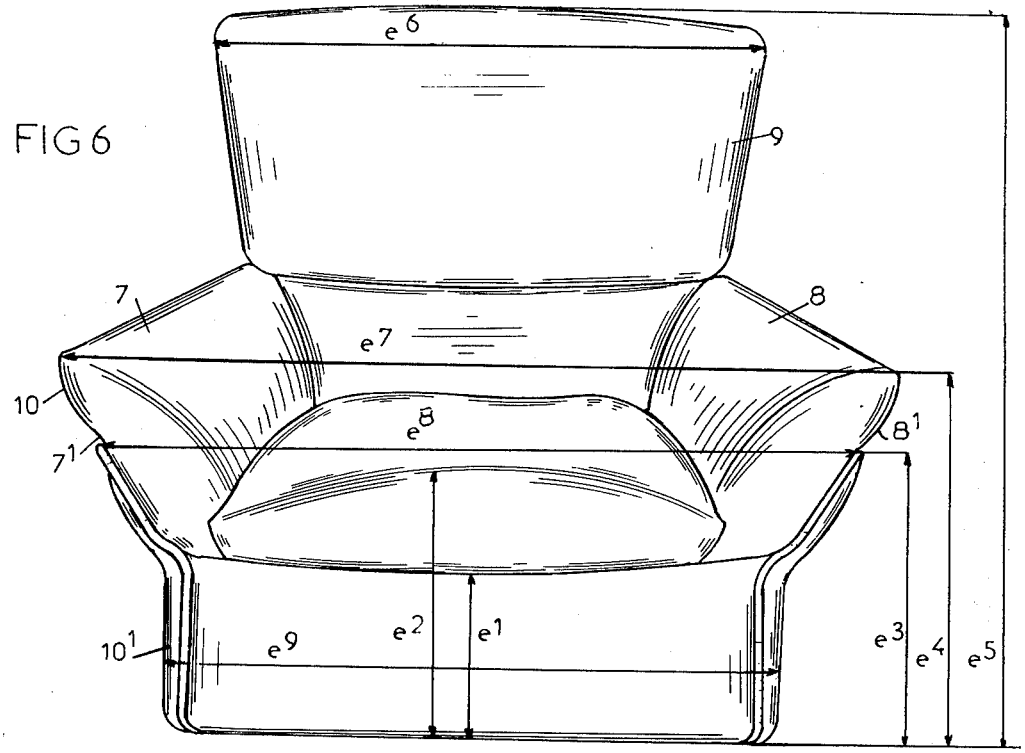

The FIG. 6 is a frontal perspective view of the chair.

Figure 7:
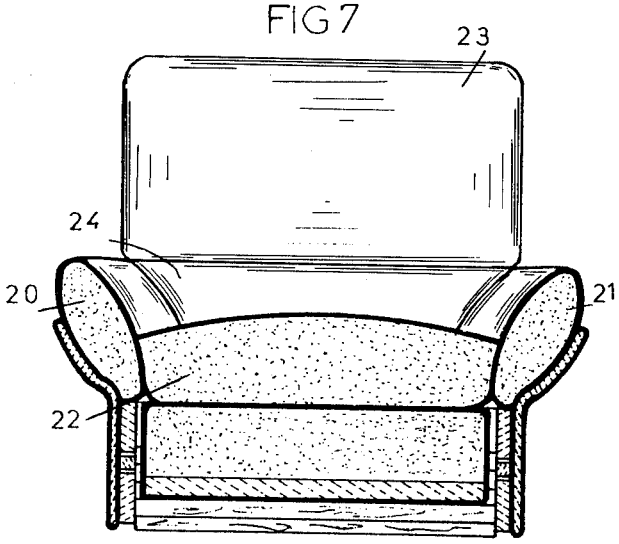

The FIG. 7 is a frontal view and section representation of the chair of a variant conception with respect to the cushion arrangement manner.

Figure 8:
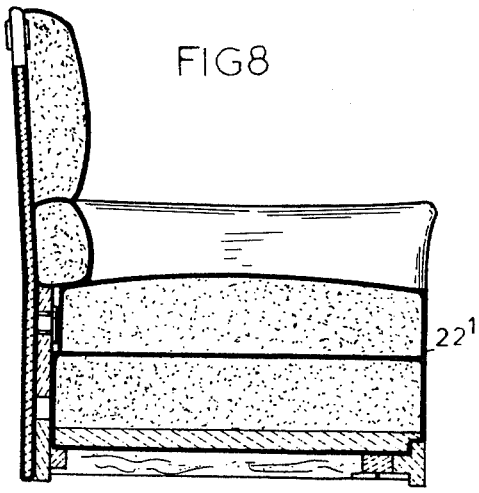

The FIG. 8 is a lateral section view along the line VIII—VIII of the FIG. 7.

The FIG. 9 is a back view of a couch showing the independent of each other positioning of the seats.

The FIG. 10 shows by means of a perspective view the different seat forming parts (the cushions excepted).

The FIG. 11 shows by means of a prespective view the conception of the back of seat element as made of tubular or shaped material.

The FIG. 12 is a perspective view showing a realization of a profilated back of seat element made of wood strips or other materials.

The FIG. 13 is a perspective view showing a chair conception in which the cushions form the elements of seat, of back of seat and of elbow rests; they are assembled together and placed on the base frame.

The FIGS. 14 and 15 are section views of the chair according to the FIG. 13 with a back of seat element according to the FIG. 10.

The FIG. 16 is a view of a partial section of the chair according to the FIG. 13 with a back of seat in conformity with the FIG. 11.

The FIG. 17 is a perspective view showing a chair according to a conception in which the back of seat element is this of the FIG. 12, and the veneering elements are these of the FIG. 10 (represented in continuous lines), the back of seat cushion being assembled with the back of seat.

The FIG. 18 is a perspective view showing a chair as per FIG. 17 but including two places.

The FIGS. 19 and 20 are partial section views showing a chair with the elbow rest elements and the back of seat element in accordance with those shown in dotted lines on FIG. 10.

The FIGS. 21 and 22 are partial section views showing two assembling manners of the back of seat cushions with the back of seat element according to the FIG. 17.

In order to better concretize the invention object it will be now described in a non-limitative manner as following the shown on Figures representations.

On the FIG. 1 there have been illustrated different elements prior to their assembling, to wit, a frame 1, two elements constituting the elbow rests 2 and 3 respectively, a back of seat element 4 and a foundation sole 5.

The modular elements 2, 3, 4 constitute the back of seat and elbow-rests framework, they are made of the glass fibre reinforced polyester. Each of them features on the one hand a lower vertical flat part, respectively $2^1$, $3^1$, $4^1$ with a formed directly together with this part horizontal rib $2^2$, $3^2$, $4^2$, and, on the other hand a shaped and possibly curved part $2^3$, $3^3$, $4^3$. The profile of the upper part $4^3$ of the back of seat is located in a plane which is visibly sloped to the exterior with respect to the lower part $4^1$ plane. Moreover, the upper end $4^4$ of the back of seat is provided with two slots $4^5$ between which there is located a recess $4^6$. An elastic ribbon 6 is positioned in its depth, between the two slots; it features in that manner two strap ends $6^1$–$6^2$, supporting indirectly the user's head through the intermediary of the back of seat forming cushion.

The upper part $2^3$, $3^3$ of the elbow-rest forming elements is shaped and curved in a manner to feature a widening towards the front, both in the horizontal, as in the vertical plane, as it is well shown on the FIG. 7.

The elements 2, 3, 4 are covered on the totality of their superficy by a fabric with a cut at the rib level, so as shown namely on the FIG. 4. Moreover, these elements receive each a cushion, respectively 7, 8, 9, which cushions are provided on one of their sides $7^1$, $8^1$, $9^1$ by pocket-like covers 10, 11, 12 intended to fit over the upper parts $2^3$, $3^3$, $4^3$ of these elements which are respectively elbow-rests and the back of seat. In this manner, it will be understood, that the cushions follow closely the framework element profiles.

The cover patterns 10, 11, 12 feature each an extension $10^1$, $11^1$, $12^1$ attached externally to the said elements, the extremities $10^2$, $11^2$, $12^2$ of these extensions are folded and terminate on the opposed interior side of the elements. On the cover pattern edges there are placed fasteners intended to cooperate with the first covering fabric layer. These fasteners can be constituted by bands known commercially under the name of VELCRO. As soon as the elbow rest and the back of seat cusions are positioned, there remain the ribs to be engaged in the slots $1^1$ on the support 1.

The outstanding feature of the frame 1 is its being monoblock, and namely made of wood; the frame is open on its front side $1^2$ in order to permit the introduction and positioning of a foundation sole 5. The lateral and back sides $1^3$, $1^4$, $1^5$ feature a slot $1^1$ for the penetration of the fastening ribs $2^2$, $3^2$, $4^2$. The back side $1^5$ is noticeably higher than the lateral sides in order to ensure a better resistance of the back of seat.

Each of the ribs features inserts 13 sunk in the glass fibre, protruding by their free ends and permitting penetration of the ties 14, or their equivalents intended to rest on the full interior sides $1^3$, $1^4$, $1^5$ of the frame. The frame features on its front side, in its lower part, a cross-tie $1^7$ which forms a support by featuring in its rear a shoulder-like clear space $1^8$. Moreover, on the back side $1^5$, in its lower part there is placed a cross tie $1^9$ whose upper surface level corresponds to the level of the frontal supporting space $1^8$; such an arrangement permits the placing and positioning of the foundation sole 5. The latter includes a support 15 whose dimensions correspond approximately to the internal dimensions of the frame, which features in its upper part $15^1$ on each side an extension $15^2$, corresponding approximately to the thickness of the lateral parts of the frame. This support 15 on its lower forward side $15^3$ has a shoulder 16 as a surface complementary to the surface formed on the frame, in order to ensure a good fit, as well as a cross tie 16 provided with fastening means such as the flange 17 ensuring the locking of the sole with respect to the frame. The lower part of the support $15^4$ comes to rest on the cross-tie $1^9$.

On the other side of the support there is placed a slab of supple matter, such as a (plastic) foam and an outer cover such as a fabric cover which ensures the sole protection.

On the sole made in such manner there is placed a seat cushion 18 whose depth is smaller than the sole depth. The fabric cover which envelops the supple matter of the cushion features two extensions $18^1$–$18^2$ intended on the one hand to cover the frontal part $5^1$ of the sole, and, on the other hand to cooperate whith the fabric which is not covered by the seat; the said extensions are provided with fastening means of the type of one commercially known under the name of VELCRO.

An intermediate back cushion 19 is thereupon placed on the chair; it rests on the one hand on the back part of the sole, and, on the other hand is being wedged between the rest of the cushions.

The chair in its final shape appears as shown on FIG. 6. As a non-limitative example, here are a few characteristic dimensions concerning this chair:

| | | |
|---|---|---|
| e1 : 23 centimeters; | e2 : 38 centimeters; | e3 : 35 centimeters |
| e4 : 46 centimeters; | e5 : 84 centimeters; | e6 : 80 centimeters |
| e7 : 96 centimeters; | e8 : 91 centimeters. | |

The FIG. 9 shows a back view of a couch. In this case the couch features a single frame whose dimensions correspond to the positioning of two or more seats. There will be found the same arrangements for the positioning of the elbow-rests and of the back of seat, each back of seat being independent of the other ones.

According to a realization shown on FIGS. 7 and 8, and starting from the same shapes and curves of the elbow-rest and back of seat elements, the cushions 20, 21, 22, 23 & 24 can be detachable and to cooperate as being fastened by bands commercially known under the name of VELCRO. The seat forming cushion 22 features only in its front part an extension $22^1$, which is intended to cover the front part of the foundation sole. The outer sides of the elbow-rests and each of seat forming elements are covered by an appropriate fabric.

It is equally possible to adapt any other type of an appropriate leg system.

According to a variant conception shown on the FIG. 10, the base frame 25 which consists of two tubular or shaped cross-ties **25*a*** placed on two different levels which delimit between themselves a peripheric space A. At each angle, the braces are rigidly fastened to the tubular or shaped risers, which constitute the legs. Preferably, but not limitatively, the risers are located inside of the frame.

The frame is preferably made of metal, which does not exclude any other matter or material with convenient characteristics.

The peripheric space A corresponds to the rib or batten placing and fitting slots of the framework and garnishing elements as defined in the preceeding realization.

On the frame constituted in such a manner there is being positioned a foundation or sole plane 26, carried-out preferably but not limitatively as a frame, whose sides **26*a*** are connected by elastic or not straps or other filling elements, which can be covered by a fabric or by a coating sheet. The foundation plane is positioned on the base frame, either by resting it on the braces and fastening by the elbow-rest or the garnishing elements protruding above the frame, or by resting it on top of risers which terminate in such a case on a level lower than the braces level.

Starting from the frame 25 and from the foundation plane 26 there will be adapted and assembled the elements of seat, elbow-rests and back of seat, as well as the garnishing or veneering elements by insertion of ribs or battens of these elements in the peripheric space A of the frame and by fastening them by such means as tongues 27 whose width is somewhat smaller than the height of the space A and which are held by and can turn about screws 28 so as to be passed in the space A and then to be turned perpendicularly to that space so as to hold and fasten the elements by the screw tightening.

According to a characteristic of this conception, the shaped and curved modular element which forms the back of seat, is an element 29 made of metallic or other tubes or shapes whose lower part constitutes an equivalent of an assembling face with the frame through the intermediary of the lower side of the peripheric frame **29*a* and of cross-ties 29*b*, one of which features swivelconnectors 29***a* and fastening means to the frame, the upper part 29*d* of the frame being preferably shaped and curved, (FIGS. 10 and 15).

The back of seat element 29 can feature a profilated and serving as a support upper part consisting of intermediate cross-tie 29*e* made of tubes or shapes (FIG. 11) which can be either vertical or horizontal, or even some ties 30, straps or equivalent supple and/or elastic resting elements, instead of the cross-ties 29*e*, or between these cross-ties (FIGS. 11 & 16).

Naturally, the back of seat element 29 is covered by a fabric, a sheet or a band of the cover material 31 (FIGS. 15 and 16), with or without a garnishing with a supple material, such as a plastic foam or alveolary material 32 (FIG. 15).

There can be also adapted a back of seat element 33 of the above described type, i.e., consisting of a plastic matter curved plate with battens and fastenings as shown in dotted lines on FIG. 10 and FIG. 20.

The back of seat can moreover, according to another realization, shown in 34 on FIGS. 12, 21 and 22, consist of strong wooden strips with a lower part 34*a* and one or more cross-ties 34*b* (one of which carries the strip 34*c* with the fastenings), forming an equivalent of an assembling plane with the frame, while the upper part is formed by the lateral shaped risers 34*d* supporting the cushions of the back of seat, either directly on these risers, or on a garnishing or on the covering of the back of seat element.

The back of seat cushions 35 with or without addition of the back-propping cushion, can be either simply resting on the back of seat element 34 or assembled in a detachable manner with the aid of different means such as self-clinging bands or ribbons, snap-holders or fastening flanges 35*a* (FIG. 17), penetrating in the risers 34*d* of the back of seat element and forming a loop (FIG. 21) or opening and permitting their closing by means of snap-holders or other means (FIG. 22). At least one bracing cross-tie 43 is preferably placed inside of the cushion, or on its back side between the risers of the back of seat element.

The shaped and curved elbow-rest element, as defined above, can be adapted as the base frame 25 so as shown by the reference number 36 in dotted lines on FIGS. 10, 20 and on the FIG. 19.

There should be noted that the said elbow-rest elements 36 are cut-out and are shorter on their curved upper part 36*a*, so as to leave a space between the front end of the elbow-rest element and the front face of the base frame, in order to use a seat-cushion 37 with a part 37*a* of it passing round, in front of the elbow-rests and their cushions.

On the lateral sides and on the front part of the base frame there can be adapted several types of garnishing or veneering elements.

On FIGS. 10, 14, 15, 17 and 19 there can be seen veneering and garnishing elements for example of wood, without exclusion of metallic or plastic elements. These elements can be either solid (38 in dotted lines on FIGS. 10, 14 and 15), or cut-out so as to form the elements 39 including a cross-tie with a strip 39*b* for the fasteners, and the risers 39*c* in the corners (FIGS. 10, 17 and 18). These elements can be either left bare so as to be painted or varnished, or to be covered with a sheet, fabric or band-shaped covers, 40, with or without interposition of a supple material of the foam type or other kind of filling. There should be noted that these elements have one or several lower faces, which are somewhat set back with respect to the lower face of the frame risers, and, preferably an upper face with a level somewhat higher than the level of the frame cross-ties, in order to serve as a frame as combined with the back of seat element for the foundation plane for the seat cushion.

According to a realization shown on FIGS. 13, 14, and 15, the cushion 41 of the seat consists of a seat cushion 41*a* and a back cushion 41*b*, a small-back propping cushion 41*c* with two elbwo-rest cushions 41*d*. This combined cushion is made all in one block, with articulate connections between the cushions made of a fabric 42 or of a supple connecting material. Alternatively, all the different cushions are left independent ones of the others, or only some of them. The whole of the cushion combination, or certain cushions are simply placed or attached in a detachable manner to the frame, the foundation plane, the elbow-rests and the back of seat with aid of different means, such as the self-clinging ribbons.

There is equally to be noted that in this case the elbow-rest cushions 41*d* are made with a stable cushion profile, with a wide resting surface on the frame permitting thus to avoid the assembly of the shaped elbow-rest elements.

As a variant, there is foreseen that the sole of foundation plane, namely for the seat-cushion itself can be carried-out of elastic or not straps, strong linen, or of leather strips and different types of springs, directly fastened or attached to the frame sides, and in particular—to the braces 25*a*.

The advantages are clear from the descriptions, there has to be stressed particularly:

the numerous adapting manners of the back of seat, elbow-rest, garnishing and veneering elements to the base frame, as well as the finishing variants by the choice, namely, of the used materials and of possible coverings.

the new and functional aesthetics of the chairs carried-out in such manner.

the facility of the elements assembling with the base frame by battens and slots and the fastening means.

the numerous possibilities of the elements assembling to multiple frames in order to make two, three and more placed chairs (FIG. 18), either aligned, or as corner models.

I claim:

1. Modular elements for making upholstered furniture such as chairs, couches, and the like comprising:

a rectangular base frame formed of a series of two tubular cross-ties placed on two different levels to define between the levels a peripheric space;

legs comprising tubular risers to which the base frame is attached;

a foundation plane, the sides of which are connected by straps, placed onto the base frame;

seat garnishing, elbow-rest, and seat back elements, each element having ribs which are inserted into the peripheric space of the base frame and are fastened by tongues whose width is slightly smaller than the height of the peripheric space and which are held by screws, the tongues being turned perpendicularly to the peripheric space so as to hold and fasten the elements.

2. Modular elements according to claim 1 wherein the base frame is made of metal.

3. Modular elements according to claim 1 wherein the straps of the base plane are covered by fabric.

4. Modular elements according to claim 1 wherein the back element slants backwards.

5. Modular elements according to claim 1 including furniture cushions for the seat, elbow rest, and seat back elements, the cushions being held together by a flexible fabric assembly.

6. Modular elements according to claim 3 wherein the fabric assembly is made of self-gripping ribbons.

7. Modular elements according to claim 1 wherein the foundation plane is made of wooden veneered elements.

* * * * *